US009562495B1

(12) United States Patent
Tucak

(10) Patent No.: US 9,562,495 B1
(45) Date of Patent: Feb. 7, 2017

(54) MODIFIED FLOAT BOWL AND DRAIN VALVE FOR A CARBURETOR

(71) Applicant: XUMA PRODUCTS OF BRADENTON, LLC, Sarasota, FL (US)

(72) Inventor: Ante Tucak, Venice, FL (US)

(73) Assignee: XUMA PRODUCTS OF BRADENTON, LLC, Sarasota, FL (US)

( * ) Notice: Subject to any disclaimer, the term of this patent is extended or adjusted under 35 U.S.C. 154(b) by 54 days.

(21) Appl. No.: 14/690,022

(22) Filed: Apr. 17, 2015

(51) Int. Cl.

| | |
|---|---|
| ***F02M 5/00*** | (2006.01) |
| ***F02M 17/36*** | (2006.01) |
| ***F02M 17/42*** | (2006.01) |
| ***F02M 5/12*** | (2006.01) |

(52) U.S. Cl.
CPC ..... *F02M 17/36* (2013.01); *F02M 5/12* (2013.01); *F02M 17/42* (2013.01)

(58) Field of Classification Search
CPC ..... F02M 5/02; F02M 5/12
USPC ..... 261/38, 72.1
See application file for complete search history.

(56) References Cited

U.S. PATENT DOCUMENTS 4,793,950 A * 12/1988 Hedlund ..... F02M 17/36 210/251

* cited by examiner

*Primary Examiner* — Robert A Hopkins

(57) ABSTRACT

A carburetor draining system for safe and convenient draining. A vessel posterior end of a vessel is disposed against a carburetor body. A vessel base is disposed against a vessel anterior end. A base aperture is disposed on the vessel base. A stem posterior portion of a drain stem is disposed inside the vessel chamber and a stem anterior portion protrudes from the base aperture. A drain port disposed through the stem posterior portion intersects a drain channel disposed inside the stem anterior portion. A locking mechanism secures the vessel to the carburetor body. A valve body of a valve is removeably disposed inside the drain channel. A first seal on the valve body is pressed against an interior surface of the drain channel. A second seal is disposed on a valve stem. A valve handle moves the valve into a closed position or an open position for draining.

17 Claims, 7 Drawing Sheets

MODIFIED FLOAT BOWL AND DRAIN VALVE FOR A CARBURETOR

FIELD OF THE INVENTION

The present invention relates to carburetors, more specifically, a carburetor with a modified float bowl and a drain valve for safe and convenient draining of the float bowl.

BACKGROUND OF THE INVENTION

Currently, four stroke, internal combustion engines typically use a carburetor for mixing fuel and air to ignite for combustion. Conventional carburetors can have a main carburetor body with mounting holes, a fuel inlet, a float valve, a fuel siphon tube, a fuel inlet port, and a float bowl secured to the siphon tube via a screw or bolt. The float bowl acts as a fuel reservoir and is typically made out of steel or other metals. As the engine consumes fuel, the float valve opens to allow more fuel to fill the float bowl.

Poor quality fuel, fuel contaminants or fuel with high percentages of ethanol may cause an engine to not start or run. Moreover, this may cause the carburetor to fail completely, thereby requiring that the carburetor be replaced. Regular maintenance of the carburetor can help prolong its life. To check for fuel quality or contamination in the carburetor, a user must open a port in the float bowl. Typically, the float bowl may have a screw or bolt that allows for the float bowl to be drained without disassembling it. The screw or bolt is removed with an appropriate tool and any contaminants and/or fuel is drained from the float bowl. This process of draining the float bowl is the same for winterizing a carburetor to prevent fuel from "souring" during an extended period of storage. One drawback to this process of draining the float bowl is that the user's' hands inevitably comes into contact with the drained contaminants and/or fuel. Hence, there is a need for a safer and more convenient assembly for draining the carburetor float bowl.

The present invention features a modified carburetor float bowl and drain valve that allows for the fuel quality to be verified visually and instantly without tools. In the event of contamination or winterization, the present invention also allows for the float bowl to be drained without the use of tools while preventing the user from contacting the drainage.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a carburetor draining system safely and conveniently drains the effluent from a vessel. In some embodiments, the carburetor draining system comprises a tubular vessel, a vessel base, a drain stem, a locking mechanism, and a valve.

DESCRIPTION OF PREFERRED EMBODIMENTS

Figure 1:
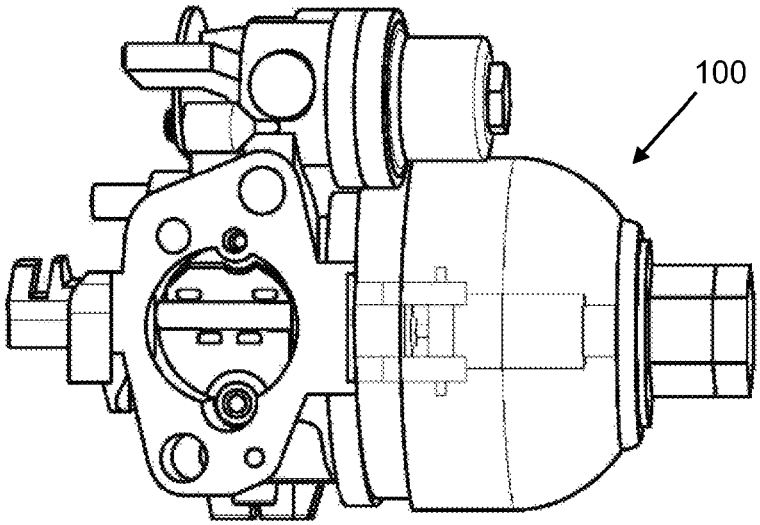
FIG. 1 shows a carburetor draining system of the present invention.

Following is a list of elements corresponding to a particular element referred to herein:

100 carburetor draining system
105 carburetor body
110 tubular vessel
111 vessel posterior end
112 vessel anterior end
113 vessel sidewall
114 vessel chamber
115 vessel base
116 base aperture
120 siphon tube
130 drain stem
131 stem posterior portion
132 stem anterior portion
133 drain port
134 drain channel
135 stem anterior end
136 interior surface
137 intersection
140 locking mechanism
150 valve
151 valve body
152 valve stem
153 hollow portion
154 valve body posterior end
155 valve body anterior end
156 first seal
157 second seal
158 valve stem posterior end

Figure 2:
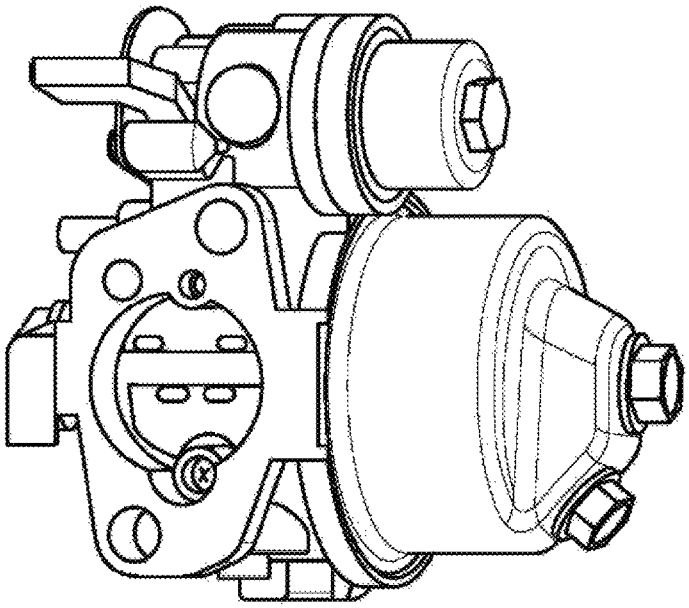
FIG. 2 (prior art)
FIG. 2 shows an example of existing carburetors.
Figure 3:
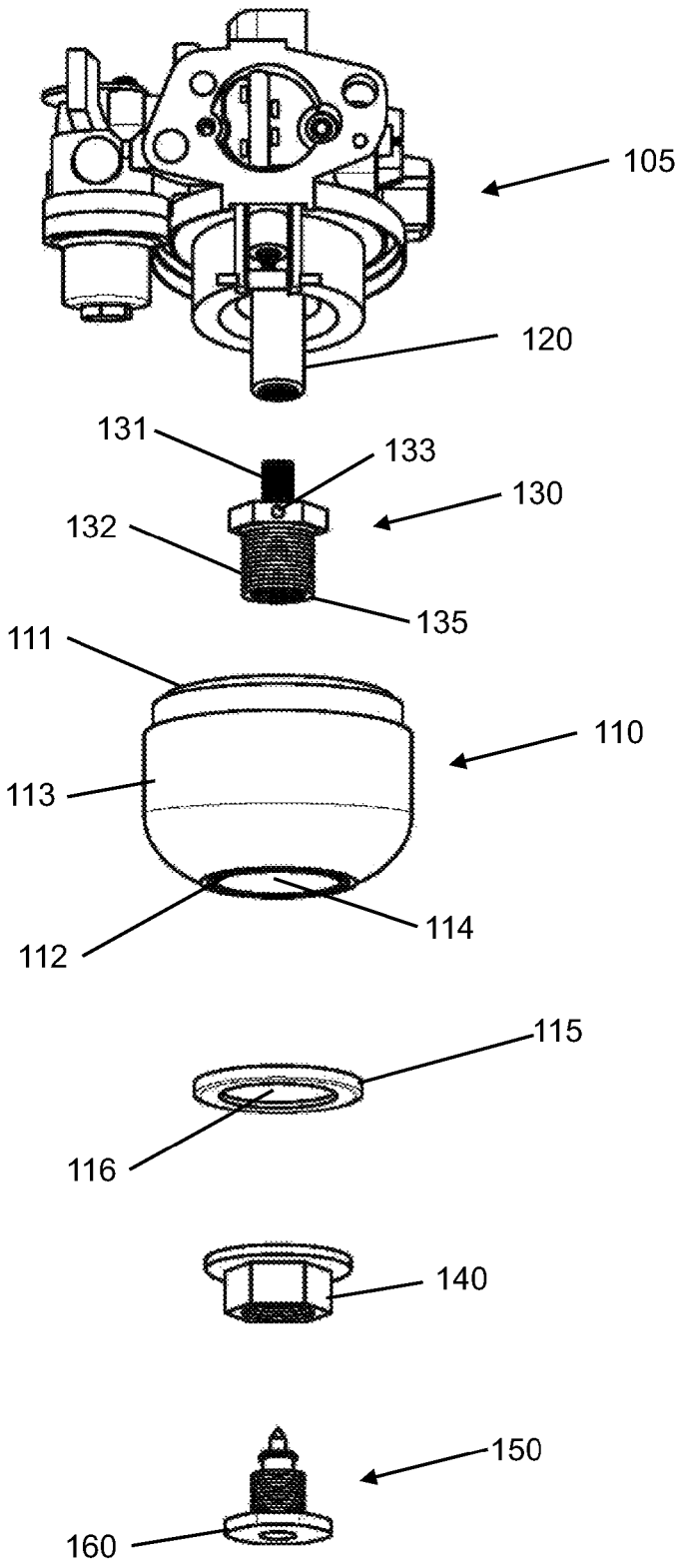
FIG. 3 shows an exploded view of the carburetor draining system.
Figure 4:
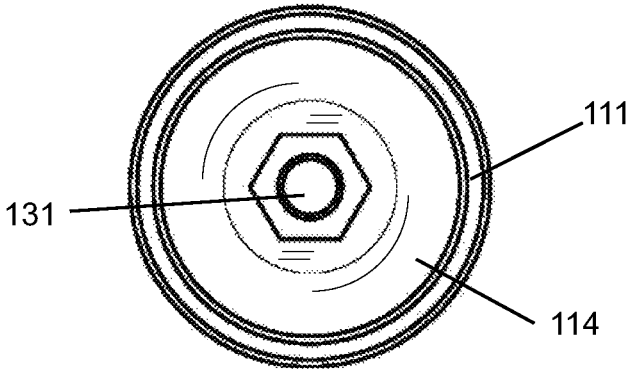
FIG. 4 shows a top view of the carburetor draining system.
Figure 5:
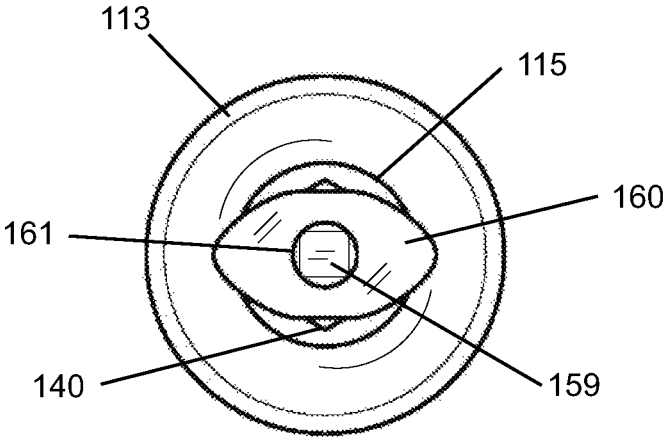
FIG. 5 shows a bottom view of the carburetor draining system.
Figure 6:
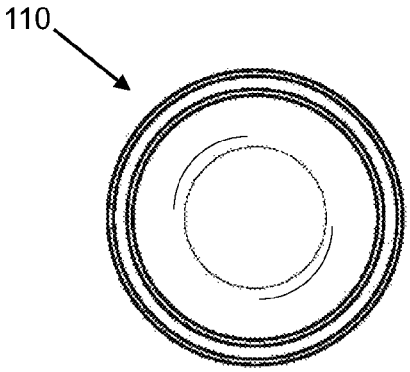
FIG. 6 shows a top view of a vessel of the carburetor draining system.
Figure 7:
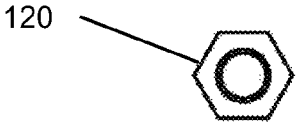
FIG. 7 shows a top view of a drain stem of the carburetor draining system.
Figure 8:
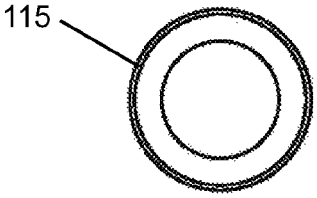
FIG. 8 shows a top view of a vessel base of the carburetor draining system.
Figure 9:
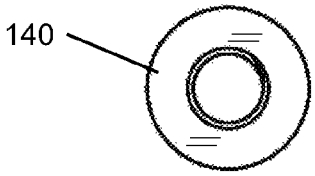
FIG. 9 shows a top view of a locking mechanism of the carburetor draining system.
Figure 10:
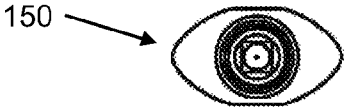
FIG. 10 shows a bottom view of a valve of the carburetor draining system.
Figure 11:
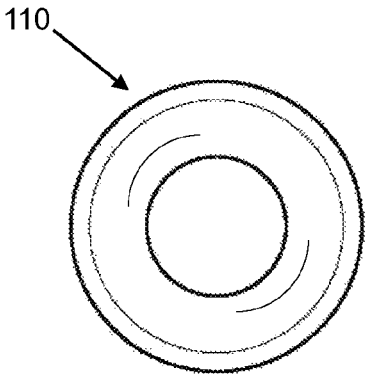
FIG. 11 shows a bottom view of the vessel of the carburetor draining system.
Figure 12:
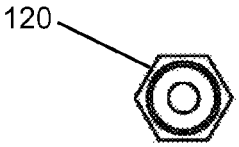
FIG. 12 shows a bottom view of the drain stem of the carburetor draining system.
Figure 13:
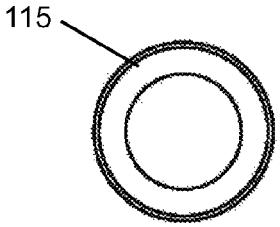
FIG. 13 shows a bottom view of the vessel base of the carburetor draining system.
Figure 14:
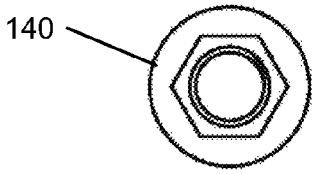
FIG. 14 shows a bottom view of the locking mechanism of the carburetor draining system.
Figure 15:
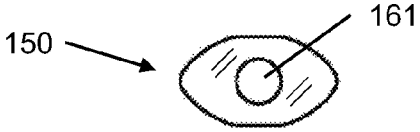
FIG. 15 shows a bottom view of the valve of the carburetor draining system.
Figure 16:
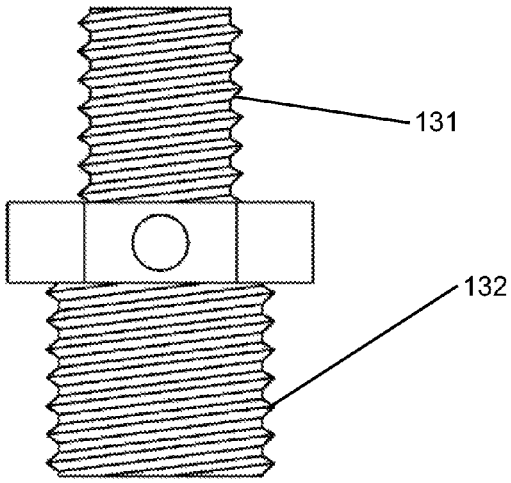
FIG. 16 shows a side view of the drain stem of the carburetor draining system.
Figure 17:
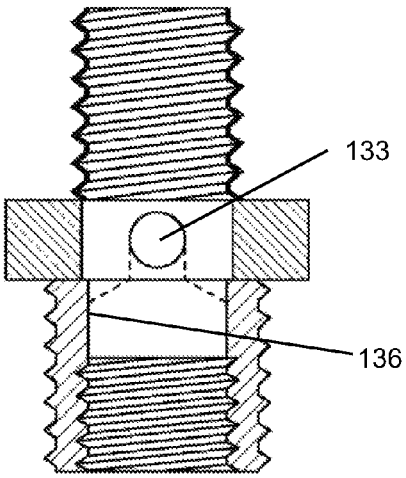
FIG. 17 shows a cross-sectional view of the drain stem.
Figure 18:
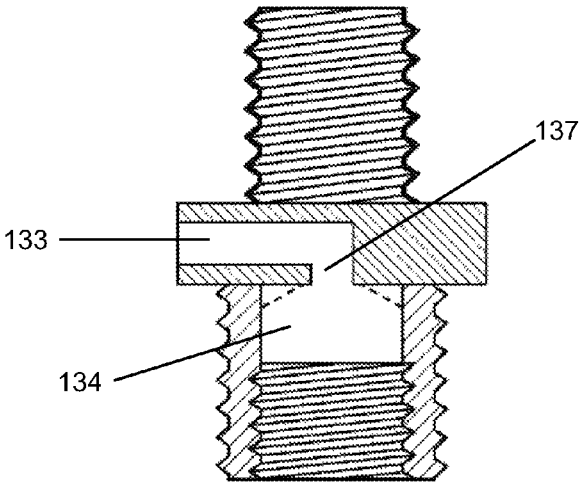
FIG. 18 shows a cross-sectional view of the drain stem.
Figure 19:
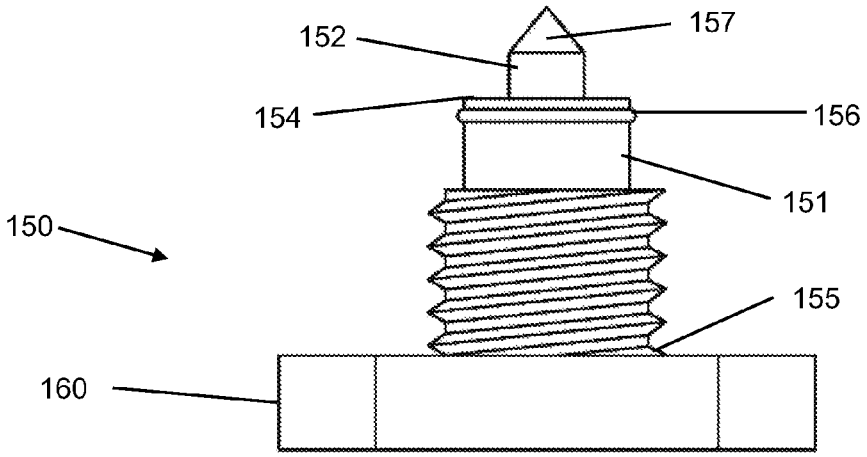
FIG. 19 shows a side view of the valve of the carburetor draining system.
Figure 20:
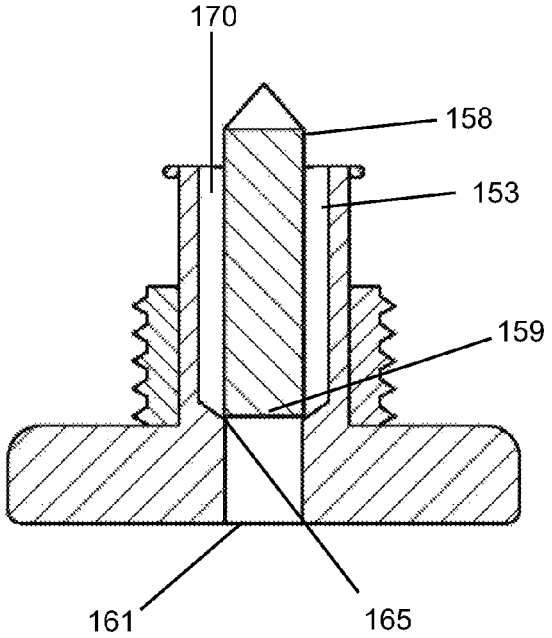
FIG. 20 shows a cross-sectional view of the valve.

159 valve stem anterior end
160 valve handle
161 handle aperture
165 stop point
170 drain path Referring now to FIG. 1-20, the present invention features a carburetor draining system (100) for draining a carburetor. In some embodiments, the carburetor draining system (100) comprises a tubular vessel (110), a vessel base (115), a drain stem (130), a locking mechanism (140), and a valve (150).

In some embodiments, the tubular vessel (110) comprises a vessel posterior end (111), a vessel anterior end (112), a substantially transparent vessel sidewall (113) disposed between the vessel posterior end (111) and the vessel anterior end (112), and an interior vessel chamber (114). The vessel posterior end (111) is disposed against a carburetor body (105). The vessel base (115) is removeably disposed against the vessel anterior end (112). In some embodiments, a base aperture (116) is disposed on the vessel base (115). For example, the base aperture (116) is disposed at the center of the vessel base (115).

In some embodiments, the drain stem (130) comprises a stem posterior portion (131), a stem anterior portion (132), and at least one drain port (133). The stem posterior portion (131) may be disposed inside the vessel chamber (114). In some embodiments, the stem posterior portion (131) may be attached to a siphon tube (120) that protrudes from the carburetor body (105) and partially extends into the vessel chamber (114). The stem anterior portion (132) may protrude from the base aperture (116). In some embodiments, the drain port (133) is disposed through the stem posterior portion (131) such that the drain port (133) is directly adjacent to the vessel base (115). Preferably, the drain port (133) intersects a drain channel (134) disposed inside the stem anterior portion (132) and that terminates at a stem anterior end (135). In other embodiments, the drain stem may have two drain ports that disposed on opposite from each other, i.e. the drain ports are space 180 degrees apart. The two drain ports may be connected to each other inside the drain stem and intersect with the drain channel. In still other embodiments, the drain stem may have more than two drain ports.

In some embodiments, the locking mechanism (140) may be removeably attached to the stem anterior portion (132) of the drain stem (130). The locking mechanism (140) secures the vessel (110) to the carburetor body (105). For example, the locking mechanism (140) may be an internally threaded nut that threads onto the externals threads disposed on the stem anterior portion (132) of the drain stem. The nut presses upon the vessel base (115) to secure the vessel (110) to the carburetor body (105). The locking mechanism (140) is not limited to a nut, but can be any suitable object capable of securing the vessel (110) to the carburetor body (105).

In some embodiments, the valve (150) may comprise a hollow valve body (151), a valve stem (152) disposed inside a hollow portion (153) of the valve body (151), and a valve handle (160) disposed on a valve body anterior end (155). The valve body (151) may be removeably disposed inside the drain channel (134). For example, the valve body may have external threads that can be threaded into the internal threads disposed on an interior surface (136) of the drain channel (134).

In some embodiments, a first seal (156) is disposed on a valve body posterior end (154) such that the first seal (156) is pressed against the interior surface (136) of the drain channel (134) to make a leak-proof seal between the drain channel (134) and the valve body (151). In some embodiments, the first seal (156) is an o-ring. In some embodiments, the first seal (156) is a thin layer of tape wrapped around the valve body, such as thread seal tape.

In other embodiments, a second seal (157) is disposed on a valve stem posterior end (158). In some embodiments, the second seal (157) is a buna-rubber cone. In other embodiments, the second seal (157) is an o-ring.

In some embodiments, a handle aperture (161) is disposed on the valve handle (160) such that the handle aperture (161) is fluidly connected to the hollow portion (153) of the valve body (151). In preferred embodiments, the valve handle (160) moves the valve (150) into an open position or a closed position. For example, the valve handle (160) may be twisted counterclockwise to open the valve by partially unthreading the valve body from the drain stem. The valve handle (160) may be twisted clockwise to close the valve by completely threading the valve body into the drain stem.

In one embodiment, when the valve (150) is in the closed position, the second seal (157) is pressed against an intersection (137) of the drain port (133) and the drain channel (134) to block a drain path (170) through the hollow portion (153) of the valve body (151). In another embodiment, when the valve (150) is in the open position, the second seal (157) is pulled away from the intersection (137) to open the drain path (170) through the hollow portion (153) of the valve body (151). For example, any effluent contained in the vessel chamber (114) enters the drain port (133), passes through the drain channel (134), flows through the hollow portion (153) of the valve body (151), and exits through the handle aperture (161).

In preferred embodiments, the vessel (110) is a bowl-shaped body. In some embodiments, the vessel (110) is a cylindrical body. In other embodiments, the vessel (110) is a rectangular body. If the vessel lacks a tapered anterior end, the vessel base (115) is preferably tapered near the base aperture (116) to allow the effluent to concentrate near the base aperture (116).

In some embodiments, the vessel chamber (114) is visible through the vessel sidewall (113). The vessel sidewall (113) may be constructed from a substantially transparent polymer material. In some embodiments, the vessel base is constructed from a metal, preferably a corrosive and chemically resistant metal.

Preferably, the vessel and vessel base are two separate pieces in order to allow for more tolerance in the vessel. This also allows for the vessel to be replaceable. In other embodiments, the vessel base is permanently attached to the vessel or the vessel and vessel base may be a single continuous unit.

In some embodiments, the stem posterior portion (131) of the drain stem (130) is threadably mated to the siphon tube (120). In other embodiments, the locking mechanism (140) is threadably mated to the stem anterior portion (132) of the drain stem (130). In still other embodiments, the valve body (151) is threadably mated to the drain channel (134).

In preferred embodiments, the valve handle (160) is hand-operable. For example, the valve handle (160) is a winged-cut handle or a T-shaped handle.

In some embodiments, the valve body is cylindrical. In preferred embodiments, the valve stem (152) is a rectangular stud. The rectangular shape allows the valve stem to remain upright in the hollow portion of the valve body so that the second seal can be inserted into the intersection point. Moreover, the rectangular shape provides space for the effluent to flow through hollow portion of the valve body. In other embodiments, the valve stem may also be a triangular stud or a cylindrical stud or any other suitable shape. In other embodiments, the valve stem may be fixed attached to the valve body.

In some embodiments, a stop point (165) is disposed on the valve handle (160). A valve stem anterior end (159) can rest upon the stop point (165) so that the stop point (165) prevents the valve stem (152) from coming out through the handle aperture (161). The stop point may be an angled surface or a concave surface, such as a lip extending from an inner surface of the handle aperture.

The carburetor draining system (100) of the present invention safely and conveniently drains the effluent from the vessel (110) by preventing any effluent from coming into contact with a person's skin. Moreover, the carburetor draining system (100) eliminates the need for tools when opening the valve to drain the vessel.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A carburetor draining system (100) for draining a carburetor, said carburetor draining system (100) comprising:

a) a tubular vessel (110) comprising a vessel posterior end (111), a vessel anterior end (112), a substantially transparent vessel sidewall (113) disposed between the vessel posterior end (111) and the vessel anterior end (112), and an interior vessel chamber (114), wherein the vessel posterior end (111) is disposed against a carburetor body (105);

b) a vessel base (115) removeably disposed against the vessel anterior end (112), wherein a base aperture (116) is disposed on the vessel base (115);

c) a drain stem (130) comprising a stem posterior portion (131), a stem anterior portion (132), and at least one drain port (133), wherein the stem posterior portion (131) is attached to a siphon tube (120) that protrudes from the carburetor body (105) and partially extends into the vessel chamber (114), wherein the stem posterior portion (131) is disposed inside the vessel chamber (114), wherein the stem anterior portion (132) protrudes from the base aperture (116), wherein the drain port (133) is disposed through the stem posterior portion (131) such that the drain port (133) is directly adjacent to the vessel base (115), wherein the drain port (133) intersects a drain channel (134) disposed inside the stem anterior portion (132), wherein the drain channel (134) terminates at a stem anterior end (135);

d) a locking mechanism (140) removeably attached to the stem anterior portion (132) of the drain stem (130), wherein the locking mechanism (140) secures the vessel (110) to the carburetor body (105);

e) a valve (150) comprising a hollow valve body (151), a valve stem (152) disposed inside a hollow portion (153) of the valve body (151), and a valve handle (160) disposed on a valve body anterior end (155), wherein the valve body (151) is removeably disposed inside the drain channel (134), wherein a first seal (156) is disposed on a valve body posterior end (154) such that the first seal (156) is pressed against an interior surface (136) of the drain channel (134) to make a leak-proof seal between the drain channel (134) and the valve body (151), wherein a second seal (157) is disposed on a valve stem posterior end (158), wherein a handle aperture (161) is disposed on the valve handle (160) such that the handle aperture (161) is fluidly connected to the hollow portion (153) of the valve body (151), and wherein the valve handle (160) moves the valve (150) into an open position or a closed position; and wherein when the valve (150) is in the closed position, the second seal (157) is pressed against an intersection (137) of the drain port (133) and the drain channel (134) to block a drain path (170) through the hollow portion (153) of the valve body (151), wherein when the valve (150) is in the open position, the second seal (157) is pulled away from the intersection (137) to open the drain path (170) through the hollow portion (153) of the valve body (151), wherein any effluent contained in the vessel chamber (114) enters the drain port (133), passes through the drain channel (134), flows through the hollow portion (153) of the valve body (151), and exits through the handle aperture (161), and wherein the carburetor draining system (100) safely and conveniently drains the effluent from the vessel (110).

2. The carburetor draining system (100) of claim 1, wherein the vessel (110) is a cylindrical body.

3. The carburetor draining system (100) of claim 1, wherein the vessel (110) is a rectangular body.

4. The carburetor draining system (100) of claim 1, wherein the vessel (110) is a bowl-shaped body.

5. The carburetor draining system (100) of claim 1, wherein the vessel chamber (114) is visible through the vessel sidewall (113).

6. The carburetor draining system (100) of claim 1, wherein the vessel sidewall (113) is constructed from a substantially transparent polymer material.

7. The carburetor draining system (100) of claim 1, wherein the stem posterior portion (131) of the drain stem (130) is threadably mated to the siphon tube (120).

8. The carburetor draining system (100) of claim 1, wherein the locking mechanism (140) is threadably mated to the stem anterior portion (132) of the drain stem (130).

9. The carburetor draining system (100) of claim 1, wherein the valve body (151) is threadably mated to the drain channel (134).

10. The carburetor draining system (100) of claim 1, wherein the first seal (156) is an o-ring.

11. The carburetor draining system (100) of claim 1, wherein the second seal (157) is a buna-rubber cone.

12. The carburetor draining system (100) of claim 1, wherein the second seal (157) is an o-ring.

13. The carburetor draining system (100) of claim 1, wherein the valve handle (160) is a winged-cut handle.

14. The carburetor draining system (100) of claim 1, wherein the valve body is cylindrical.

15. The carburetor draining system (100) of claim 1, wherein the valve stem (152) is a rectangular stud.

16. The carburetor draining system (100) of claim 1, wherein a stop point (165) is disposed on the valve handle (160), wherein a valve stem anterior end (159) rest upon the stop point (165), wherein the stop point (165) prevents the valve stem (152) from coming out through the handle aperture (161).

17. The carburetor draining system (100) of claim 1, wherein the valve handle (160) is hand-operable.

* * * * *